United States Patent [19]

Wiltshire

[11] Patent Number: 4,462,285

[45] Date of Patent: Jul. 31, 1984

[54] POWER TOOL MARKING SYSTEM

[75] Inventor: Antony R. Wiltshire, Kettering, England

[73] Assignees: Ford Motor Company, Dearborn, Mich.; Desitech Limited, England

[21] Appl. No.: 429,367

[22] PCT Filed: Feb. 11, 1982

[86] PCT No.: PCT/GB82/00032

§ 371 Date: Sep. 30, 1982

§ 102(e) Date: Sep. 30, 1982

[87] PCT Pub. No.: WO82/02684

PCT Pub. Date: Aug. 19, 1982

[30] Foreign Application Priority Data

Feb. 11, 1981 [GB] United Kingdom ..... 8104216

[51] Int. Cl.[3] ..... B25B 23/14

[52] U.S. Cl. ..... 81/468

[58] Field of Search ..... 81/468

[56] References Cited

U.S. PATENT DOCUMENTS

| | | | |
|---|---|---|---|
| Re. 29,444 | 10/1977 | Alexander | 173/12 |
| 3,523,471 | 8/1970 | Lance | 81/468 |
| 3,719,111 | 3/1973 | Study | 81/468 |
| 3,774,479 | 11/1973 | Lesner | 81/468 |

FOREIGN PATENT DOCUMENTS

| | | | |
|---|---|---|---|
| 2530078 | 1/1977 | Fed. Rep. of Germany . | |
| 2530077 | 3/1977 | Fed. Rep. of Germany | 81/468 |
| 2714914 | 10/1978 | Fed. Rep. of Germany . | |
| 2828380 | 1/1980 | Fed. Rep. of Germany . | |
| 1349202 | 4/1974 | United Kingdom . | |

*Primary Examiner*—James L. Jones, Jr.

*Attorney, Agent, or Firm*—Paul K. Godwin, Jr.; Robert D. Sanborn

[57] ABSTRACT

A power tool comprises a drive shaft (16), a tool (20) for engaging a threaded bolt fastener (22) and marking means (30) for marking the threaded fastener after it has been tightened onto a compatibly threaded hole. The marking means (30) comprises a marking stylus (41, 42, 45, 48, 49) that is moved reciprocally into and out of contact with the fastener, and supply means (62, 63, 61) for supplying a predetermined quantity of liquid marking medium to the stylus for discharge therefore onto the fastener with each cycle of linear movement of the stylus.

6 Claims, 4 Drawing Figures

POWER TOOL MARKING SYSTEM

TECHNICAL FIELD

This invention relates to a power tool and an associated mechanism for marking threaded fasteners such as bolts that have been torqued into a compatibly threaded hole by the power tool.

BACKGROUND ART

Conventional power tools, such as those used in the assembly of motor vehicles, generally comprise a pneumatic motor connected to a drive shaft that is adapted to carry a tool, such as a hexagonal drive socket for engaging a threaded fastener. Some known power tools incorporate marking means for visibly marking the fastener when the fastener has been tightened to a required torque. This visible indication can then be used for quality control purposes. In one such tool, the marking means comprises a spray device which delivers a quantity of liquid marking material sprayed from a jet onto the workpiece in the region of the fastener when the desired torque has been applied to the fastener. The use of a spray suffers from the disadvantages that the amount of liquid marking medium applied to the workpiece and the position at which the medium is applied are difficult to control. Thus, the tool itself can easily become contaminated with the marking medium, and, if the jet is not aligned correctly with the workpiece, the presence of the marking medium can be difficult to detect.

DISCLOSURE OF INVENTION

The present invention provides a power tool comprising a motor for rotating a drive shaft. The drive shaft is adapted to carry a tool at its torque head for engaging a threaded fastener and to carry a marking means for marking the fastener. The marking means comprises a marking stylus mounted for reciprocating movement along the torque axis into and out of contact with the fastener engaged in the tool carried by the torque head. Means are also included within the marking means for supplying a predetermined quantity of liquid marking medium to the marking stylus, for discharged therefrom onto the fastener, with each cycle of reciprocating movement of the marking stylus.

By arranging the marking stylus to reciprocate into and out of contact with the fastener and supplying predetermined quantities of marking medium to the stylus during each cycle of reciprocating movement, a controlled amount of marking medium can be deposited accurately onto the workpiece, thereby producing an accurate and reliable visible indication on the workpiece.

In the preferred embodiment of the invention, the marking stylus comprises a first piston mounted for reciprocal movement within a bore in the marking means. A marking head is carried by the first piston and the first piston contains a central conduit for conducting marking fluid from one end of the first piston to the marking head at the other end. The supply means includes a second piston mounted for reciprocal movement in the bore in line with the first piston so as to define a chamber between the first and second pistons. The second piston contains a conduit, for conducting marking fluid from a reservoir at one end of the second piston to the defined chamber, and valve means for controlling the flow of marking fluid through the chamber. The relative reciprocation of the first and second pistons thereby pumps marking fluid from the reservoir, through the chamber and into the marking head.

In order to prevent the marking medium from dripping from the chamber, the marking stylus preferably includes a pressure operated valve that controls the amount of marking fluid that flows along the conduit from the chamber to a marking head. Additionally, the marking head may preferably include a porous pad that in use, becomes impregnated with the marking medium.

The pistons may be reciprocated in the marking means by any suitable means, e.g., electrically, hydraulically or pneumatically. Preferably, however, the pistons are reciprocated pneumatically by fluid pressure.

The pistons are preferably reciprocally moved together between two end positions of the pistons by the application of fluid pressure to the pistons remote from the chamber. One of the pistons is additionally moved by fluid pressure in the chamber away from other piston and into engagement with a further stop when the other piston is at an end position.

If desired, the relative movement of the two pistons may be controlled by a mechanical link therebetween. Alternatively, the pistons may be retained in engagement throughout their reciprocation by the application of a suitable differential pressure to the pistons remote from their adjacent ends.

In order to facilitate cleaning of the tool, the marker head is preferably removably mounted on a shaft which defines the conduit in the marking stylus. The shaft may itself be removably connected to the piston of the marking stylus and preferably the marking means is removably mounted as a unit on the power tool.

BEST MODE OF CARRYING OUT THE INVENTION

Figure 1:
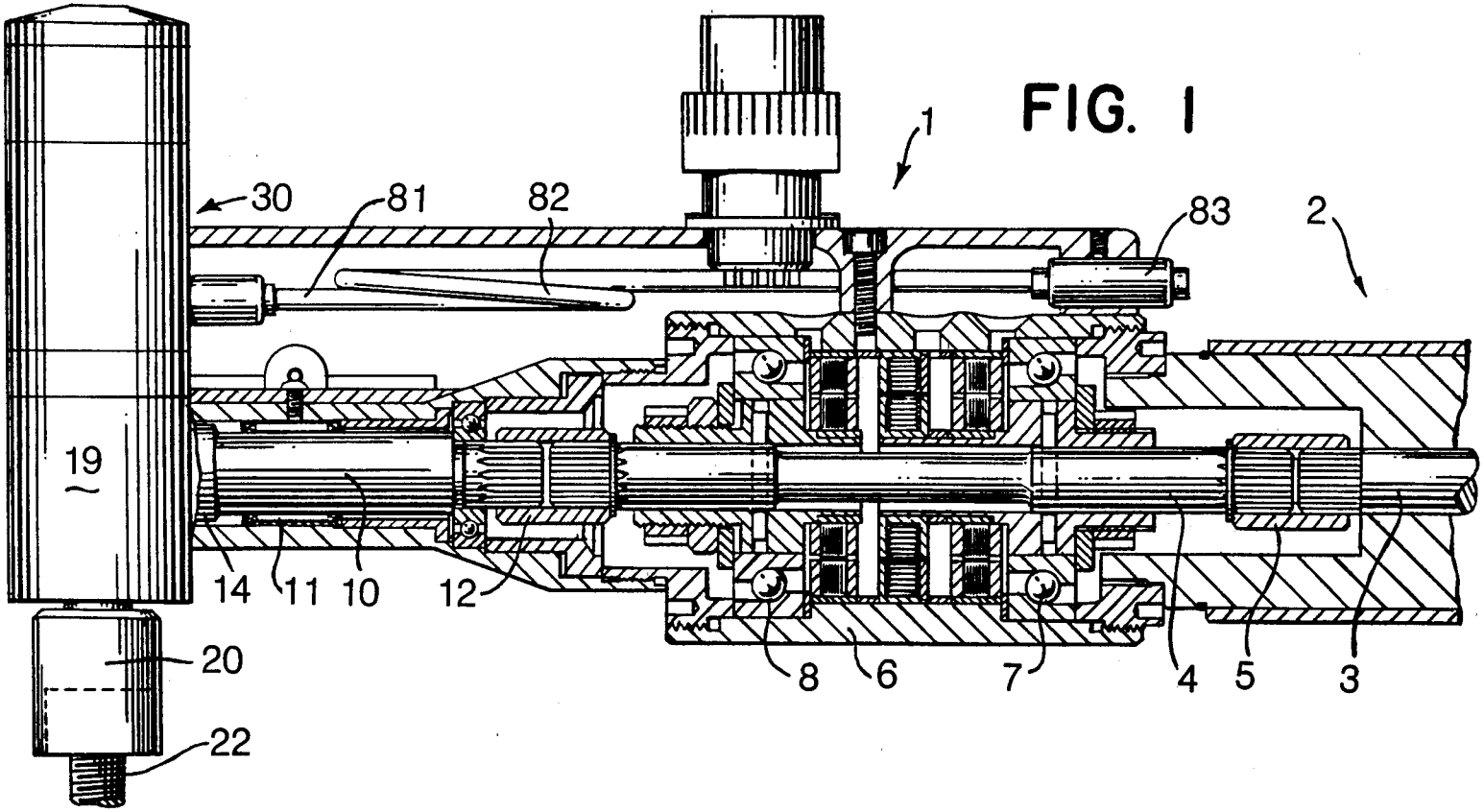
FIG. 1 is a partial cross-sectional view of a power tool portion of the present invention.
Figure 2:
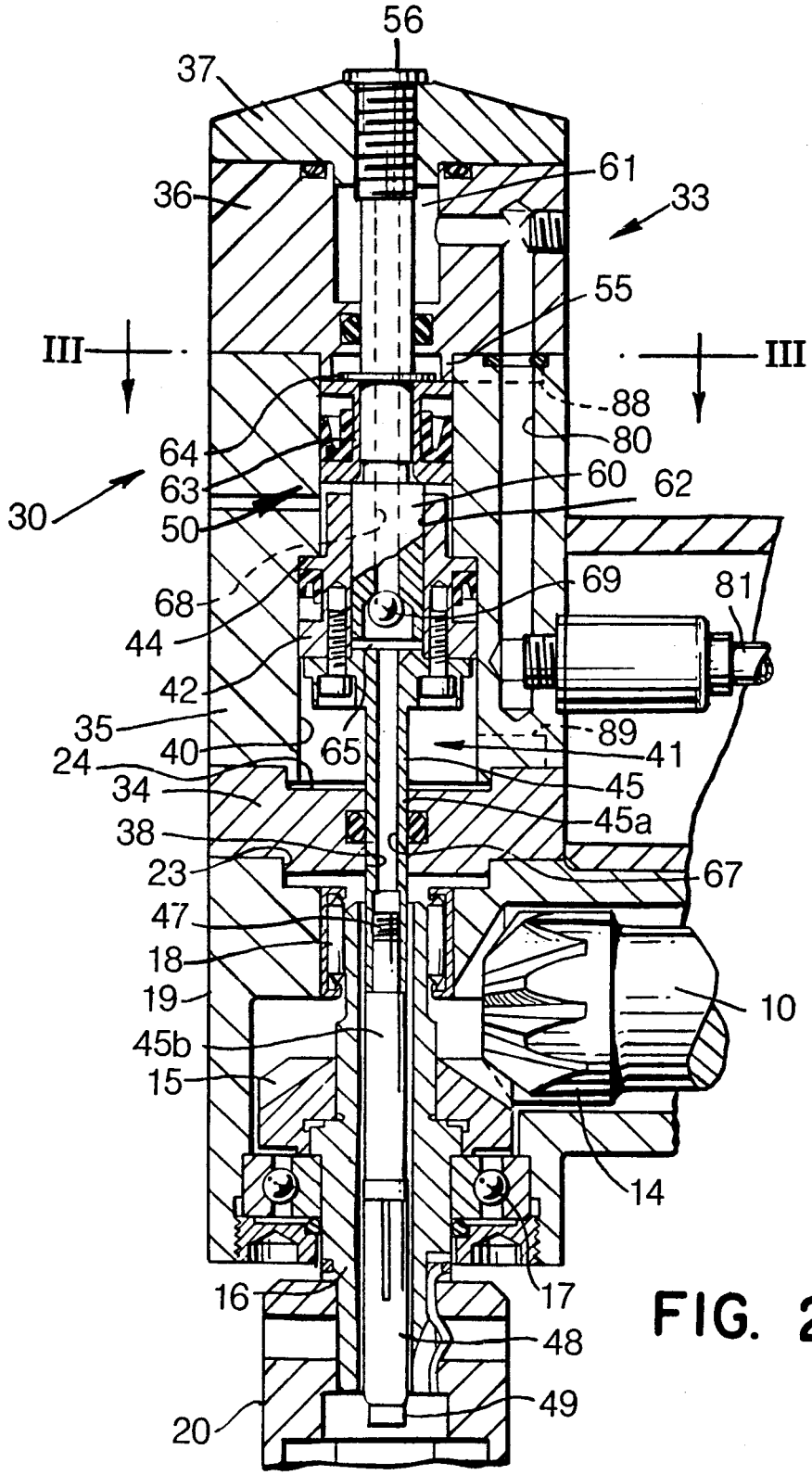
FIG. 2 is an enlarged cross-sectional view of the marker portion of the power tool shown in FIG. 1.

Referring to FIGS. 1 and 2 of the drawings, a power tool 1 is shown, which is suitable for use in assembly-line production of motor vehicles. The tool comprises a pneumatic motor 2 of conventional construction, which is not shown in detail. An output shaft 3 is coupled coaxially from the motor 2 to an intermediate shaft 4 by a splined connection 5. The intermediate shaft 4 is rotatably mounted in the housing 6 of the tool 1 by bearings 7, 8 and is coupled coaxially to a first drive shaft 10 by means of a splined connection 12. The drive shaft 10 is rotatably mounted in the housing 6, by needle bearings 11, and terminates in a bevel gear 14 which meshes with a bevel gear 15 (FIG. 2) within an end portion 19 of the housing 6. The bevel gear 15 is secured to a second drive shaft 16, which is hollow and rotatably mounted on bearings 17 and 18. The second drive shaft 16 is arranged to rotate on an axis that is oriented approximately 90° to the axis of rotation of the first drive shaft 10. A drive socket 20 is removably mounted in a conventional manner on one end of the second drive shaft 16 for engagement with a workpiece, indicated schematically as a hexagonal bolt head 22.

Figure 3:
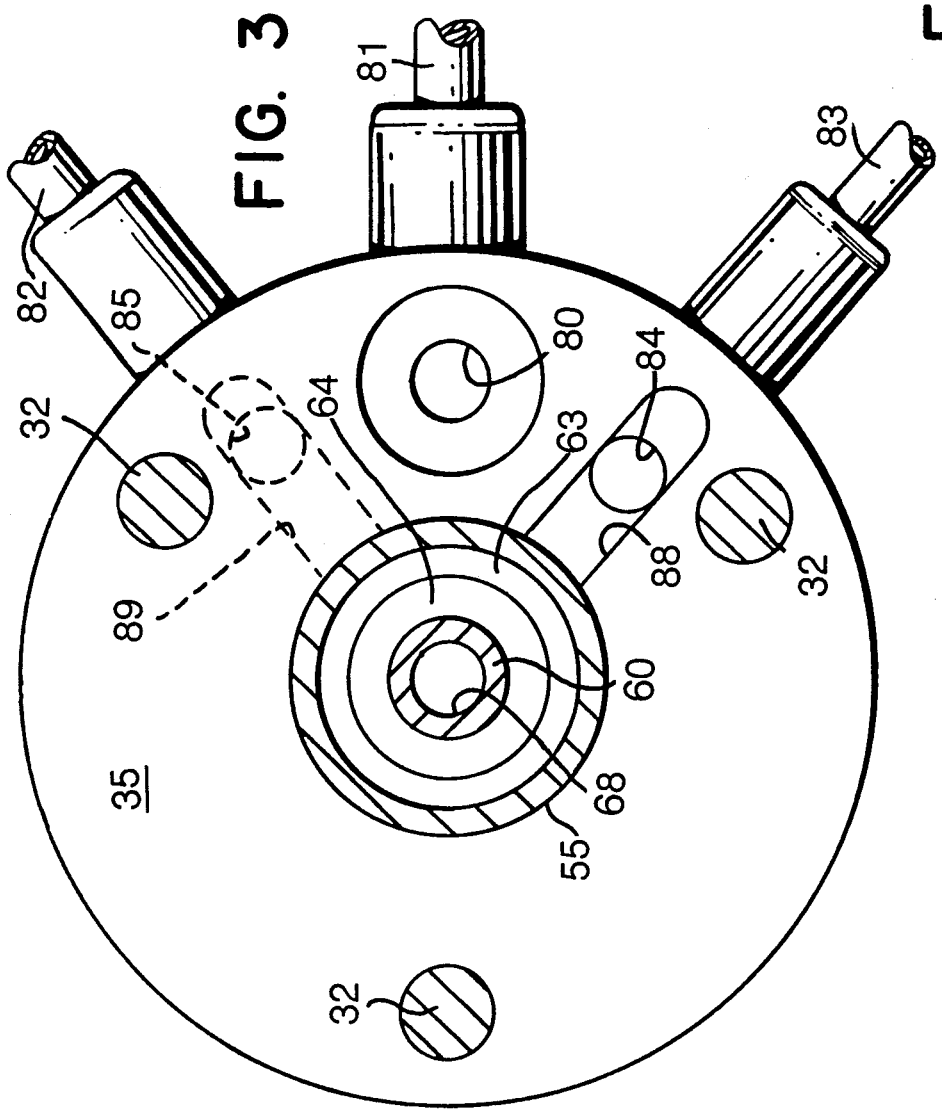
FIG. 3 is a cross-sectional view along line III—III of FIG. 2.

A marking unit 30 is removably mounted on the end portion 19 of the housing 6 by three bolts 32 (FIG. 3) and comprises a housing 33. The housing 33 comprises a stack of four cylindrical blocks 34, 35, 36 and 37.

The first cylindrical housing block 34 mates with a central recess 23 in the end portion 19 and has a central aperture 38 coaxial with the hollow opening of the second drive shaft 16.

The second housing block 35 mates with a recess in the upper surface of housing block 34 and contains a central bore 40 having upper and lower sections of different diameters supported by an internal shoulder 44.

The third housing block 36 contains a circular stop wall 55, that mates with the upper surface and upper bore of the block 35, and defines a reservoir chamber 61.

The fourth housing block 37 provides an upper seal to the reservoir chamber 61 and housing 30 and mates with the upper portion of block 36.

A marking stylus 41 within the lower section of the central bore 40 is mounted for reciprocating motion therein. The stylus 41 includes a centrally apertured piston 42 that is bolted to a hollow shaft 45 which extends from the second housing block 35, through the aperture 38 in the first housing block 34 and into the hollow drive shaft 16. The upper surface 24 of the first housing block 34 and the internal shoulder 44 in the bore 40 provide stops for limiting the reciprocating movement of the piston 42.

Figure 4:
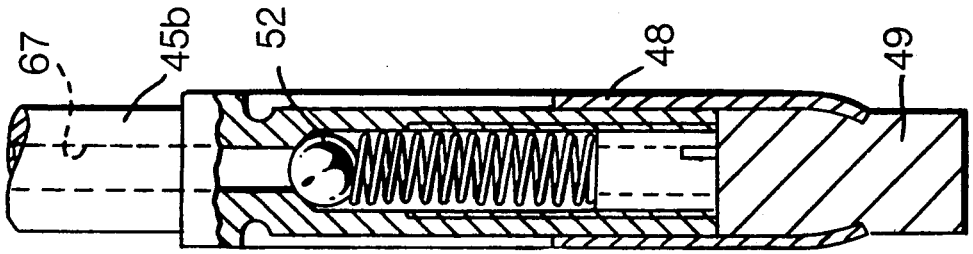
FIG. 4 is an enlarged cross-sectional view of the marker head shown in FIG. 2.

The shaft 45 includes an upper tube 45*a*and a lower tube 45*b* secured together by a threaded connection 47. The lower end of the lower tube 45*b* carries a tubular marker head 48 (see FIG. 4), which is slidably fitted thereon. A pad 49 of porous material, such as felt, is crimped into the end of the marker head 48. A pressure operated valve includes a spring biased ball valve 52 that is mounted within the lower end of the lower tube 45*b* in the tubular body of the marker head 48 to close the lower end of the lower tube 45*b*.

Marking fluid is supplied to the pad 49 along a conduit 67 defined by the hollow center of the shaft 45 by means of a second piston 50, mounted in the upper section of the central bore 40 in the second housing block 35. The second piston 50 includes a central hollow shaft 60, which projects out of the second housing block 35 into the reservoir chamber 61 in the third housing block 36. The lower end of the shaft 60 is received in a recess 62 in the upper end of the piston 42 and is machined so as to produce a sliding fit therein. A flange member 63 seals the shaft 60 with respect to the walls of the bore 40 and is secured in abutment with a shoulder on the central shaft 60 by means of a circular clip 64.

The chamber 65 defined by the end of the central shaft 60 of the second piston 50 and the recess 62 in the first piston 41 communicates with the conduit 67 through the marking stylus and with a further conduit 68 formed by the hollow interior of the shaft 60. The latter houses a ball valve 69 which engages a valve seat in the lower end of the shaft 60 to control the flow of marking fluid along the hollow shaft 60 from the reservoir chamber 61.

The reservoir chamber 61 is closed by the fourth housing block 37 which carries an adjustment screw 56. The adjustment screw provides an adjustable stop for the upward movement of the shaft 60 of the second piston. Liquid marking medium is fed to the reservoir chamber 61 from a supply passage 80 in the second and third blocks 35 and 36, respectively. The supply passage 80 is coupled to one end of a flexible feed line 81 within the housing 6 of the power tool 1. The feed line 81 includes a loop 82 (FIG. 1) which enables the marking unit 30 to be removed as a unit from the end 19 of the housing 6 for maintenance purposes. The other end of the feed line 81 is secured in the housing 6 by a connector 83 which enables the feed line 81 to be connected to a pressurized source of liquid marking medium (not shown).

The second housing block 35 is also connected to air feed lines 82 and 83 of similar construction to the feed line 81. The air feed lines are respectively connected to air passages 84 and 85 in the second housing block 36 (FIG. 3), which respectively communicate with the central bore 40 on the respective upper and lower surfaces of the piston 42 and 50, via passages 88 and 89 formed in the upper and lower surfaces of the housing block 35.

In use, the bolt head 22 is tightened by operating the motor 2, which rotates the intermediate shaft 4 and drive shafts 10 and 16. When a desired torque has been applied to the bolt head, the marker unit 30 is actuated. Any conventional method may be used to determine the moment at which the marker is actuated. For example, the intermediate shaft 4 may incorporate torque detectors, which provide electrical output signals which may be processed to trigger the marking means. Suitable methods will be known to persons skilled in the art, and need not be described here.

Throughout the operation of the tool, the liquid marking medium is maintained at a constant pressure so that the reservoir 61, conduit 68, chamber 65 and conduit 67 are filled with marking medium. While the bolt head 22 is being rotated, air is applied at low pressure along line 82, into the lower part of the bore 40 and air feed line 83 is vented to atmosphere. As a result, the low air pressure from line 83 forces the first piston 42 upwardly as seen in FIG. 2 into engagement with the stop shoulder 44. The differential pressure exerted on the second piston 50 by the liquid marking medium in the reservoir 61 and the chamber 65 maintains the second piston in contact with the stop wall 55, as illustrated in FIG. 2.

When the bolt head 22 has been tightened sufficiently, high air pressure is fed along air feed line 85 into the upper part of the bore 40 to act upon the second piston 50. The second piston therefore beings to move downwardly into the bore 40. The downward movement will be transmitted to the first piston 41 through the liquid marking medium in the chamber 65 and the first piston 41 will also move downwardly against the force exerted thereon by the low pressure air fed to the lower end of the chamber 40. The downward movement of the first piston 41 will cause the pad 49 into contact with the bolt head 22. When the first piston 42 engages the upper surface 24 of the first housing block 34, the upper piston 50 will continue to travel into the recess 62 and cause displacement of the liquid marking medium from the chamber 65, along the conduit 67 and through the pad 49 so that a discrete quantity of liquid marking medium will be discharged from the pad 59 and onto the bolt head 22.

The air feed line 83 is then vented to atmosphere so that the low pressure air in line 82 forces the lower piston 41 upwardly towards the shoulder 44 in the bore 40. The upper piston 50 travels upwardly with the lower piston 42 until the lower piston reaches the end of its travel. The pressure of liquid marking medium in the chamber 61 causes the medium to flow past the ball valve 69 during the time the upper piston 50 travels upwardly in the bore 40, and enters the chamber 65, until the top of the piston 60 engages the adjustment screw 56.

This operation is repeated for each cycle of reciprocation. A quantity of liquid marking material is pumped from the reservoir 61, through the chamber 65 and past the biased valve 52 to the marking head 48 on each downward movement of the marking stylus 45. Therefore each bolt head will be marked consistently and accurately and without fouling the tool.

If the tool is left unattended for some time, so that the marking medium begins to set within the marking unit 30, the marking head 48 can be quickly removed and replaced by another head. The original head may be discarded or cleaned. The lower end of the lower tube 45*b* can also be quickly removed and replaced by unscrewing the threaded connector 47, should the material in the lower part of the stylus become solidified. If necessary, the complete unit can also be removed quickly and easily for repair or cleaning by unscrewing the bolts 32 and disconnecting the air and marking medium feed lines.

I claim:

1. A power tool adapted to engage, torque and mark a threaded fastener comprising:

means for engaging said fastener;

means for rotating said engaging means about an axis;

means for marking said fastener when said fastener is torqued a predetermined amount, wherein said marking means comprises a marking stylus mounted for reciprocal movement with respect to said engaging means into and out of contact with said engaged fastener;

means for supplying a predetermined quantity of liquid marking medium to said marking stylus for discharge therefrom directly onto said fastener when said fastener is torqued a predetermined amount;

means for reciprocally moving said marking stylus into and out of contact with said engaged fastener;

said marking means includes a central bore and said marking stylus comprises a first piston mounted in said bore for reciprocal linear movement therein, said first piston includes a first conduit for conducting marking fluid along its length and a marking head at one end of said conduit for contacting said engaged fastener when said first piston is moved to a second position within said bore;

said supplying means includes a reservoir for storing a quantity of said liquid marking medium under pressure and a second piston having one end extending into said reservoir, being mounted in said bore for reciprocal linear movement therein and for defining a chamber between said first and second pistons at its other end;

said second piston includes a second conduit for conducting said liquid marking fluid from said reservoir to said chamber and a valve means for preventing reverse flow of said marking medium within said second conduit, whereby reciprocal movement of said first and second pistons causes liquid marking medium to be pumped from said reservoir via said chamber to said marking head.

2. A power tool as in claim 1, wherein said first piston includes a pressure actuated valve for allowing said liquid marking fluid to flow along said first conduit from said chamber to said marking head.

3. A power tool as in claim 2, wherein said moving means applies controlled fluid pressure to said first and second pistons to effect linear reciprocal movement within said bore.

4. A power tool as in claim 3, wherein said moving means causes said first and second piston to move together from a first position defined as a first movement limit for both said pistons to a second position defined as a second movement limit for said first piston, causes said second piston to move to a third position within said chamber to actuate said pressure actuated valve and pump a predetermined amount of liquid marking medium into said first conduit toward said marking head and then causes said first and second pistons to return to said first position in a reciprocal cycle.

5. A power tool as in claim 4, wherein said moving means causes reciprocal movement of said first and second pistons along said axis of rotation of said engaging means.

6. A power tool as in claim 5, wherein said marking head comprises a porous pad which is impregnated with said liquid marking medium.

* * * * *